US007471252B2

(12) United States Patent
Onaka et al.

(10) Patent No.: US 7,471,252 B2
(45) Date of Patent: Dec. 30, 2008

(54) ANTENNA STRUCTURE AND RADIO COMMUNICATION APPARATUS INCLUDING THE SAME

(75) Inventors: Kengo Onaka, Yokohama (JP); Jin Sato, Yokohama (JP); Masahiro Izawa, Sagamihara (JP)

(73) Assignee: Murata Manufacturing Co., Ltd., Nagaokakyo-shi (JP)

( * ) Notice: Subject to any disclaimer, the term of this patent is extended or adjusted under 35 U.S.C. 154(b) by 0 days.

(21) Appl. No.: 11/778,148

(22) Filed: Jul. 16, 2007

(65) Prior Publication Data

US 2007/0257850 A1 Nov. 8, 2007

Related U.S. Application Data

(63) Continuation of application No. PCT/JP2005/023639, filed on Dec. 22, 2005.

(30) Foreign Application Priority Data

Jan. 18, 2005 (JP) ..... 2005-010589

(51) Int. Cl.
*H01Q 1/24* (2006.01)

(52) U.S. Cl. ..... 343/702

(58) Field of Classification Search ..... 343/702, 343/700 MS, 770, 767, 846
See application file for complete search history.

(56) References Cited

U.S. PATENT DOCUMENTS 5,861,854 A * 1/1999 Kawahata et al. ..... 343/702
5,867,126 A * 2/1999 Kawahata et al. ..... 343/702
6,323,811 B1 * 11/2001 Tsubaki et al. ..... 343/700 MS
6,437,744 B1 * 8/2002 Akiyama et al. ..... 343/700 MS
6,492,946 B2 * 12/2002 Nagumo et al. ..... 343/700 MS
6,677,902 B2 * 1/2004 Akiyama et al. ..... 343/700 MS
2002/0196192 A1 12/2002 Nagumo et al.
2004/0036653 A1 2/2004 Ishihara et al.

FOREIGN PATENT DOCUMENTS

JP 10-107535 9/1995
JP 2000-201015 7/2000

(Continued)

*Primary Examiner*—Huedung Mancuso
(74) *Attorney, Agent, or Firm*—Dickstein, Shapiro, LLP.

(57) ABSTRACT

An antenna structure including a dielectric base member provided in a non-ground region of a circuit board and a feed radiation electrode provided on the dielectric base member. An outer side surface of the dielectric base member along an edge of one end of the circuit board defines a side surface. A feed electrode is provided in the non-ground region of the circuit board or outside the circuit board such that the feed electrode is disposed along side surfaces of the dielectric base member. One end of the feed radiation electrode defines a feed end connected to the feed electrode, and the other end of the feed radiation electrode defines an open end. The feed radiation electrode has a configuration in which a current path extending from the feed end to the open end has a loop shape so as to be provided on at least the side surface and an upper surface of the dielectric base member. A feed radiation electrode portion formed on the side surface of the dielectric base member 6 forms a capacitance between the feed radiation electrode portion and the feed electrode for improving antenna characteristics.

11 Claims, 7 Drawing Sheets

FOREIGN PATENT DOCUMENTS

| | | |
|---|---|---|
| JP | 2001-217631 | 8/2001 |
| JP | 2004-164211 | 11/2002 |
| JP | 2003-273767 | 9/2003 |
| JP | 2004-166242 | 6/2004 |
| JP | 2004-194211 | 7/2004 |
| JP | 2004-357043 | 12/2004 |
| JP | 2005-210523 | 8/2005 |
| WO | WO 01/06596 | 1/2001 |

* cited by examiner

ANTENNA STRUCTURE AND RADIO COMMUNICATION APPARATUS INCLUDING THE SAME

CROSS REFERENCE TO RELATED APPLICATIONS

The present application is a continuation of International Application No. PCT/JP2005/023639, filed Dec. 22, 2005, which claims priority to Japanese Patent Application No. JP2005-010589, filed Jan. 8, 2005, the entire contents of each of these applications being incorporated herein by reference in their entirety.

FIELD OF THE INVENTION

The present invention relates to an antenna structure provided in a radio communication apparatus, such as a portable telephone, and a radio communication apparatus including the same.

BACKGROUND OF THE INVENTION

FIG. 11*a* is a perspective view schematically showing an example of an antenna structure. FIG. 11*b* is an exploded view schematically showing the antenna structure. FIG. 11*c* shows the antenna structure shown in FIG. 11*a* when viewed from the bottom side. The antenna structure 1 includes an antenna 2. The antenna 2 is mounted in a non-ground region Zp of a circuit board 3. That is, a ground region Zg in which a ground 4 is formed and the non-ground region Zp in which the ground 4 is not formed are arranged next to each other on the circuit board 3 such that the non-ground region Zp is disposed on one end of the circuit board 3. The antenna 2 is mounted in the non-ground region Zp of the circuit board 3. As a board of a non-ground region, for example, a glass-epoxy board whose both surfaces are not coppered can be used.

The antenna 2 includes a dielectric base member 6, a feed radiation electrode 7, and a non-feed radiation electrode 8. The dielectric base member 6 is a rectangular parallelepiped (a rectangular column). On the upper surface of the dielectric base member 6, the feed radiation electrode 7 and the non-feed radiation electrode 8 are arranged with a space therebetween. The feed radiation electrode 7 and the non-feed radiation electrode 8 are electromagnetically coupled to each other to produce a multiple-resonance state. In addition, on a side surface 6*a*, which is an outer side surface of the dielectric base member 6 along an edge of the one end of the circuit board 3 near a top side remote from the ground 4, a feed end Q of the feed radiation electrode 7 and a short end S of the non-feed radiation electrode 8 are formed.

In addition, in the non-ground region Zp of the circuit board 3, a feed electrode 10 (10B) connected to the feed end Q of the feed radiation electrode 7 is provided. The feed electrode 10 (10B) is an electrode pattern that extends along side surfaces of the dielectric base member 6 from a portion connected to the feed end Q of the feed radiation electrode 7 toward the ground region Zg. An end of the feed electrode 10 (10B) near the ground region Zg is connected to a high-frequency circuit 12 for radio communication of a radio communication apparatus. In addition, in the non-ground region Zp of the circuit board 3, a ground connection electrode 11 (11B) connected to the short end S of the non-feed radiation electrode 8 is provided. The ground connection electrode 11 (11B) is an electrode pattern that extends along side surfaces of the dielectric base member 6 from a portion connected to the short end S of the non-feed radiation electrode 8 toward the ground region Zg. An end of the ground connection electrode 11 (11B) near the ground region Zg is grounded to the ground 4.

In the antenna structure 1, for example, when a signal for radio communication is supplied from the high-frequency circuit 12 for radio communication to the feed radiation electrode 7 via the feed electrode 10 (10B), the feed radiation electrode 7 resonates. The non-feed radiation electrode 8, which is electromagnetically coupled to the feed radiation electrode 7, also resonates. Thus, the feed radiation electrode 7 and the non-feed radiation electrode 8 produce a multiple-resonance state, and a signal is transmitted wirelessly.

Patent Document 1: Japanese Unexamined Patent Application Publication No. 2001-217631

For example, in the antenna structure 1 shown in FIG. 11*a*, the feed radiation electrode 7 and the non-feed radiation electrode 8 are mainly provided on the upper surface of the dielectric base member 6. Thus, electromagnetic fields radiated from the feed radiation electrode 7 and the non-feed radiation electrode 8 are concentrated on the upper surface of the dielectric base member 6. Thus, a problem occurs in which a Q-value, which is an antenna characteristic, is likely to increase and in which a frequency bandwidth for radio communication is likely to decrease. In addition, there is a problem in which antenna characteristics deteriorate due to increases in conductive loss and dielectric loss.

In addition, in order to realize an electrical length to achieve a required resonant frequency, slits may be formed in the feed radiation electrode 7 and the non-feed radiation electrode 8. However, since the feed radiation electrode 7 and the non-feed radiation electrode 8 are provided on the upper surface of the dielectric base member 6, that is, provided on a single surface of the dielectric base member 6, the feed radiation electrode 7 and the non-feed radiation electrode 8 have limited electrode areas. Thus, when a slit-formed area within an electrode unit area of each of the feed radiation electrode 7 and the non-feed radiation electrode 8 increases, the electrode width of a current path of each of the feed radiation electrode 7 and the non-feed radiation electrode 8 decreases. This causes a problem in which conductive loss increases in the feed radiation electrode 7 and the non-feed radiation electrode 8. In addition, as the slit-formed area increases, a configuration of each of the feed radiation electrode 7 and the non-feed radiation electrode 8 becomes more complicated.

In addition, metal or high-dielectric materials (for example, human fingers or the like) are often above the antenna 2. In this case, radio waves radiated from the feed radiation electrode 7 and the non-feed radiation electrode 8 are blocked by the metal or high-dielectric materials. This causes a problem in which antenna gain decreases. In addition, a problem occurs in which changes in impedances of the feed radiation electrode 7 and the non-feed radiation electrode 8 caused by a distance change of an object regarded as a ground deteriorate antenna characteristics.

SUMMARY OF THE INVENTION

In the present invention, the configuration given below serves as means for solving the problems. That is, an antenna structure according to the present invention includes a ground region in which a ground is formed, a non-ground region in which the ground is not formed, the ground region and the non-ground region are provided next to each other such that the non-ground region is disposed on one end of a board; a dielectric base member of a rectangular column shape provided in the non-ground region of the board or on the non-ground region and outside of the board; and a feed radiation electrode provided on the dielectric base member; an outer side surface of the dielectric base member along an edge of the one end of the board defines a side surface near a top side, and in the non-ground region of the board or outside the board, a feed electrode connected to a circuit for radio communication provided in the ground region is provided along a side surface of the dielectric base member or an outer edge of the board; one end of the feed radiation electrode defines a feed end, which is connected to the feed electrode, on the side surface of the dielectric base member near the top side, the other end of the feed radiation electrode defines an open end, and the feed radiation electrode has a configuration in which a current path extending from the feed end to the open end has a loop shape so as to be provided on at least the side surface near the top side and an upper surface next to the side surface of the dielectric base member; a feed radiation electrode portion formed on the side surface of the dielectric base member near the top side forms a capacitance for improving antenna characteristics between the feed radiation electrode portion and the feed electrode provided along the side surface of the dielectric base member or the outer edge of the board in the non-ground region of the board.

According to the present invention, the feed radiation electrode has a configuration in which the current path extending from the feed end to the open end has a loop shape so as to be provided on at least the side surface near the top side and the upper surface of the dielectric base member. That is, the feed radiation electrode has a configuration to use at least the side surface near the top side and the upper surface of the dielectric base member. Thus, compared with a case where the feed radiation electrode is provided only on the upper surface of the dielectric base member, an electromagnetic field of the feed radiation electrode is dispersed. Accordingly, since conductive loss and dielectric loss can be reduced, the antenna characteristics can be improved.

In addition, since the electromagnetic field of the feed radiation electrode is dispersed, a Q-value, which is an antenna characteristic, can be reduced. Thus, an increase in the frequency bandwidth for radio communication can be achieved.

In addition, according to the present invention, the capacitance for improving the antenna characteristics is formed between the feed radiation electrode portion formed on the side surface of the dielectric base member near the top side and the feed electrode. That is, in other words, since the capacitance for improving the antenna characteristics is formed on the side surface that is opposite to a side surface of the dielectric base member that faces the ground region, an electric field can be concentrated on the side surface of the dielectric base member that is remote from the ground region. Thus, the amount of electric field attracted to the ground in the ground region from the feed radiation electrode can be reduced. This also reduces the Q-value, which is an antenna characteristic, and a further increase in the frequency bandwidth for radio communication can be achieved. In addition, due to the reduction in the amount of electric field attracted to the ground, the antenna efficiency can be improved.

In addition, when it is assumed that the antenna structure according to the present invention is contained within a radio communication apparatus, such as a portable telephone, and that metal or a high-dielectric material (for example, a human finger) is placed near the feed radiation electrode from above the board (the dielectric base member), since the feed radiation electrode is provided not only on the upper surface of the dielectric base member but also on the side surface near the top side and the capacitance for improving the antenna characteristics is formed between the feed radiation electrode portion formed on the side surface near the top side and the feed electrode, when the metal or the high-dielectric material is above the feed radiation electrode, the amount of electric field of the feed radiation electrode attracted to the metal or the high-dielectric material can be reduced. Thus, deterioration in the antenna gain due to the metal or the high-dielectric material (for example, a human finger) placed near the feed radiation electrode from above the ground can be reduced.

As described above, with the characteristic configuration according to the present invention, the antenna performance of an antenna structure can be improved. In particular, when an antenna operation in a fundamental mode with the lowest resonant frequency among a plurality of resonant frequencies of the feed radiation electrode and an antenna operation in a higher-order mode with a resonant frequency higher than that in the fundamental mode are performed, the antenna performance of the antenna operation in the higher-order mode can be improved. In addition, since, as described above, the antenna structure according to the present invention is capable of improving the antenna performance, a radio communication apparatus containing the antenna structure according to the present invention is capable of improving the reliability in radio communication.

In addition, in the present invention, since the feed radiation electrode is provided on the upper surface and the side surface near the top side of the dielectric base member, compared with a case where the feed radiation electrode is provided only on the upper surface of the dielectric base member, an electrode area of the feed radiation electrode can be increased. Thus, for example, the feed radiation electrode easily realizes an electrical length enough for achieving a required resonant frequency. In addition, since the electrical length of the feed radiation electrode is increased due to addition of the impedance based on the capacitance for improving the antenna characteristics formed between the feed radiation electrode and the feed electrode to the feed radiation electrode, when a slit is formed in the feed radiation electrode in order to achieve a longer electrical length, the slit length formed in the feed radiation electrode can be reduced. Furthermore, as described above, since the electrode area of the feed radiation electrode is increased, the proportion of the slit-formed area to a unit area of the feed radiation electrode can be reduced. Thus, a simpler configuration of the feed radiation electrode can be achieved.

MHz for explaining an advantage achieved by the configuration of the antenna structure according to the first embodiment.

Figure 4A:
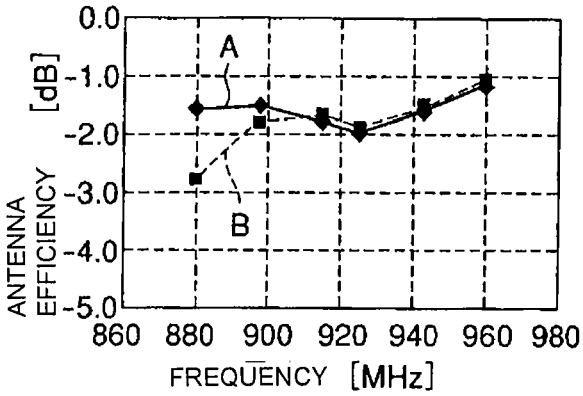
FIG. 4*a* is a graph showing an example of antenna efficiency in a frequency band between 880 MHz and 960 MHz for explaining an advantage achieved by the configuration of the antenna structure according to the first embodiment.
Figure 4B:
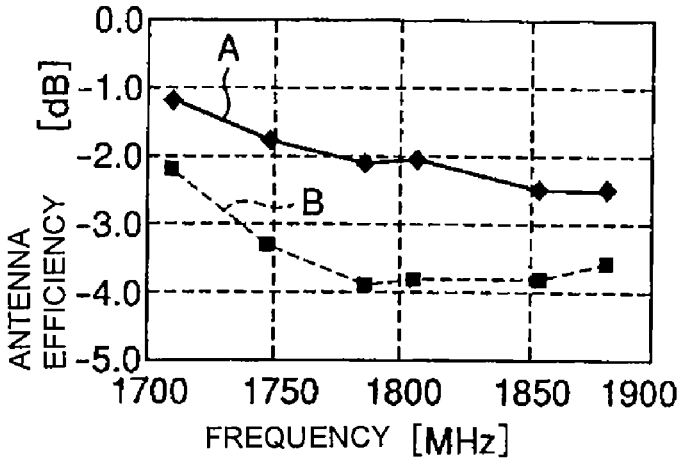
FIG. 4*b* is a graph showing an example of antenna efficiency in a frequency band between 1710 MHz and 1880
Figure 4C:
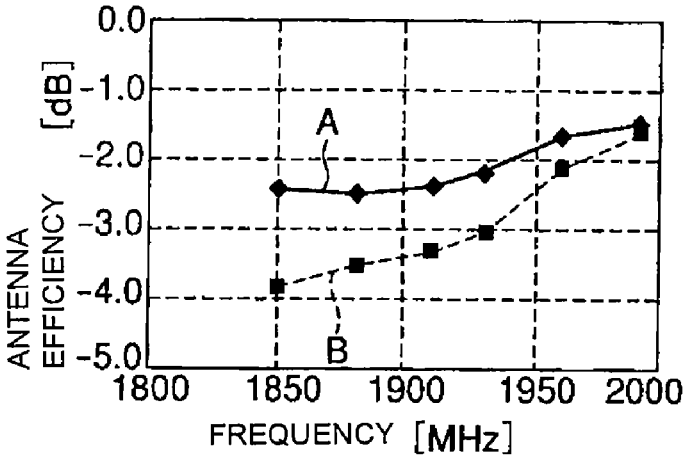

FIG. 4*c* is a graph showing an example of antenna efficiency in a frequency band between 1850 MHz and 1990 MHz for explaining an advantage achieved by the configuration of the antenna structure according to the first embodiment.

Figure 4D:
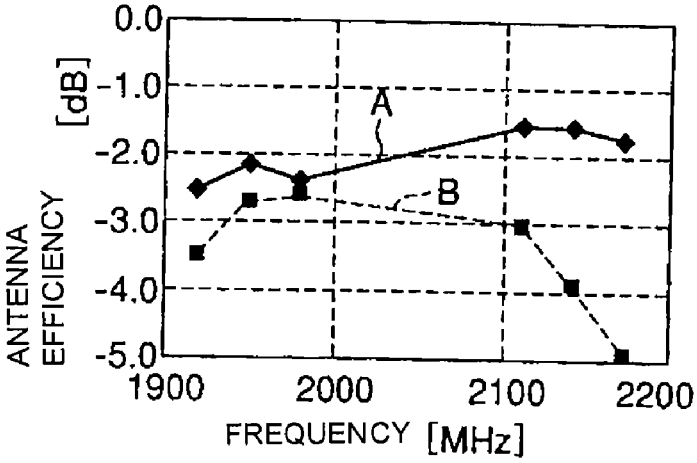

FIG. 4*d* is a graph showing an example of antenna efficiency in a frequency band between 1920 MHz and 2170 MHz for explaining an advantage achieved by the configuration of the antenna structure according to the first embodiment.

Figure 5A:
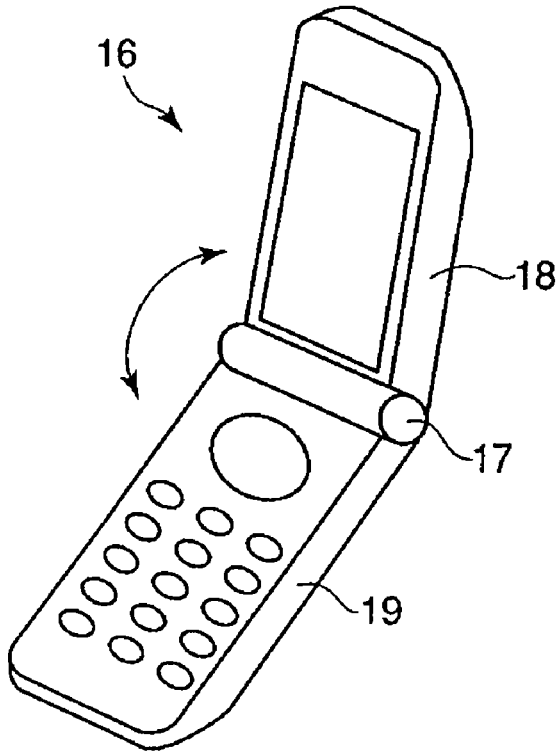

FIG. 5*a* is a model diagram for explaining another advantage achieved by the configuration of the antenna structure according to the first embodiment.

Figure 5B:
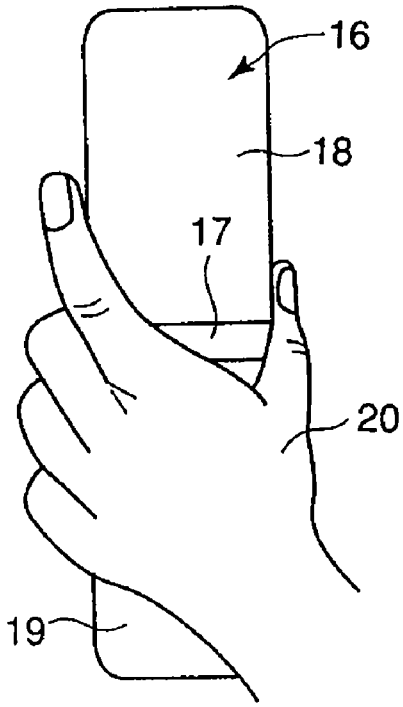

FIG. 5*b* is a model diagram for explaining, together with FIG. 5*a*, the advantage achieved by the configuration of the antenna structure according to the first embodiment.

Figure 1A:
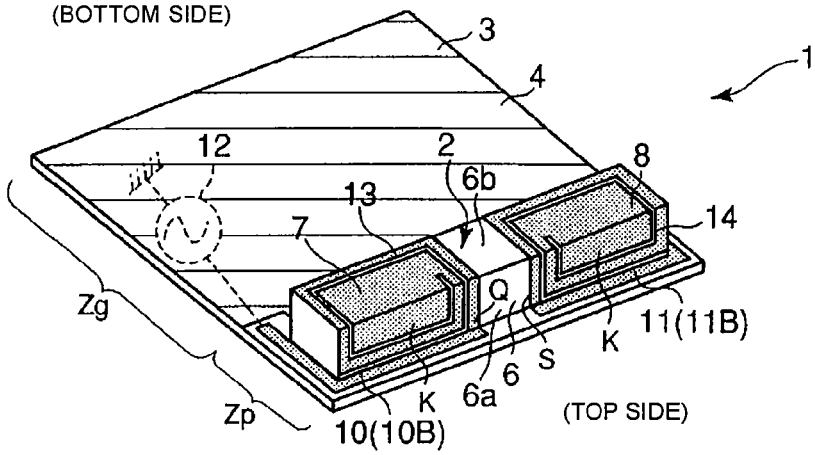
FIG. 1*a* is an illustration for explaining an antenna structure according to a first embodiment.
Figure 6:
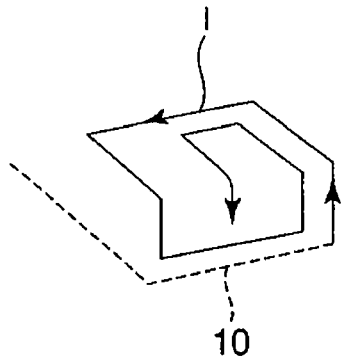

FIG. 6 is an illustration schematically showing a current path in a fundamental mode of the feed radiation electrode shown in FIG. 1*a*.

Figure 7A:
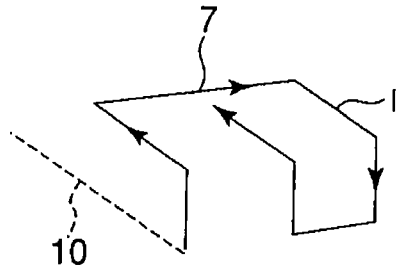

FIG. 7*a* is a model diagram showing a current path in the fundamental mode for explaining another example of the feed radiation electrode.

Figure 7B:
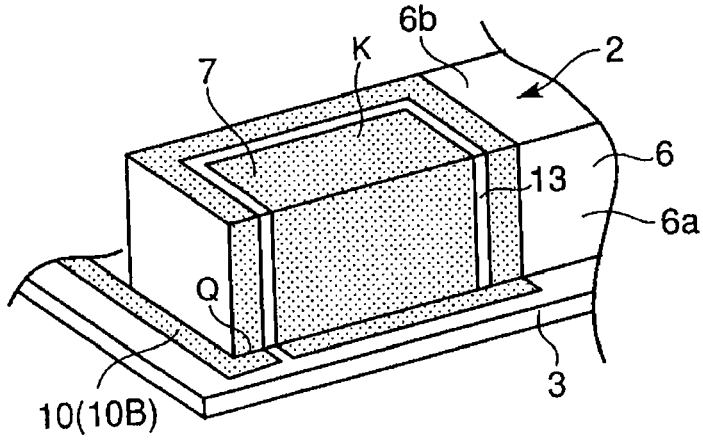

FIG. 7*b* is an illustration for explaining the example of the feed radiation electrode having the current path in the fundamental mode shown in FIG. 7*a*.

Figure 8A:
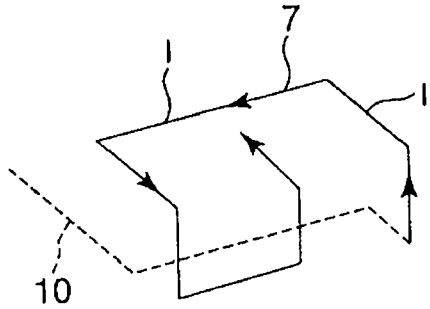

FIG. 8*a* is a model diagram showing a current path in the fundamental mode for explaining still another example of the feed radiation electrode.

Figure 8B:
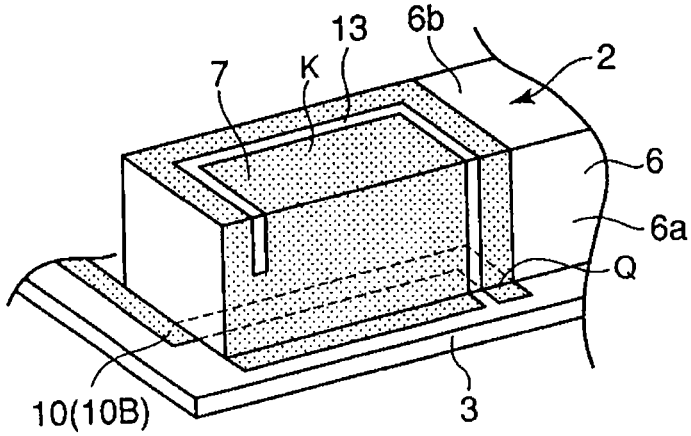

FIG. 8*b* is an illustration for explaining the example of the feed radiation electrode having the current path in the fundamental mode shown in FIG. 8*a*.

Figure 9:
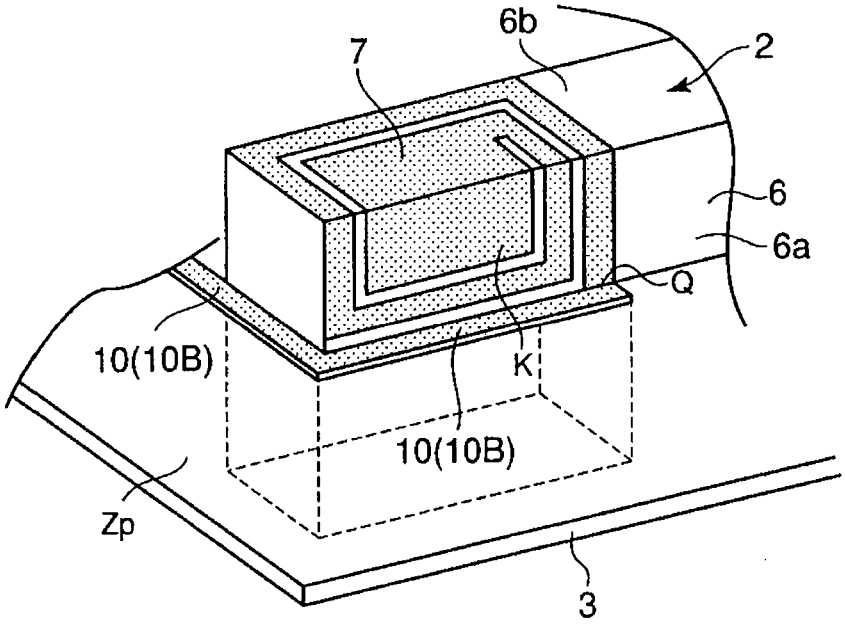

FIG. 9 is an illustration for explaining still another example of the feed radiation electrode.

Figure 10:
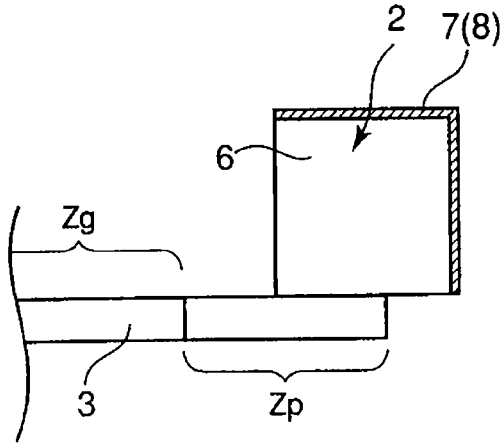

FIG. 10 is an illustration for explaining an antenna structure according to a second embodiment.

Figure 11A:
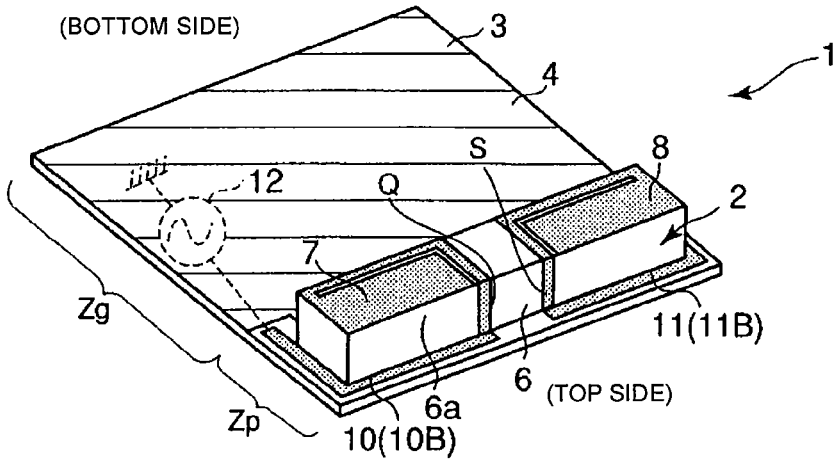

FIG. 11*a* is an illustration for explaining an antenna structure according to a known example.

Figure 11B:
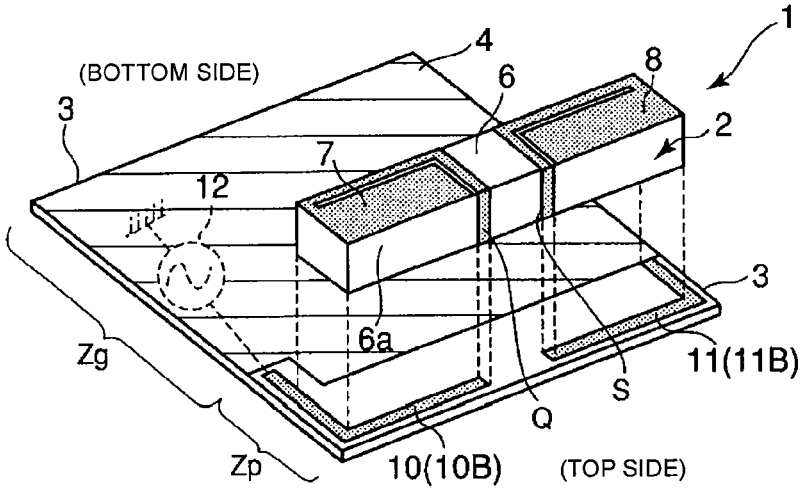

FIG. 11*b* is an exploded view schematically showing the antenna structure shown in FIG. 11*a*.

Figure 11C:
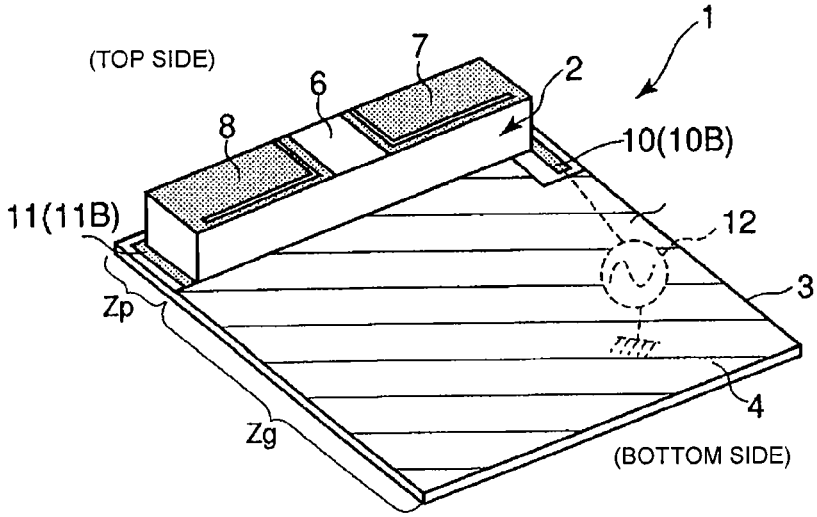

FIG. 11*c* is a model diagram showing the antenna structure shown in FIG. 11*a* when viewed from a bottom side.

REFERENCE NUMERALS

1 antenna structure
3 circuit board
4 ground
6 dielectric base member
7 feed radiation electrode
8 non-feed radiation electrode

DETAILED DESCRIPTION OF THE INVENTION

Embodiments of the present invention will now be described with reference to the drawings. In the explanations of the embodiments given below, parts with the same names as in the antenna structure shown in FIG. 11*a* are referred to with the same reference numerals, and the descriptions of those same parts will be omitted here.

Figure 1B:
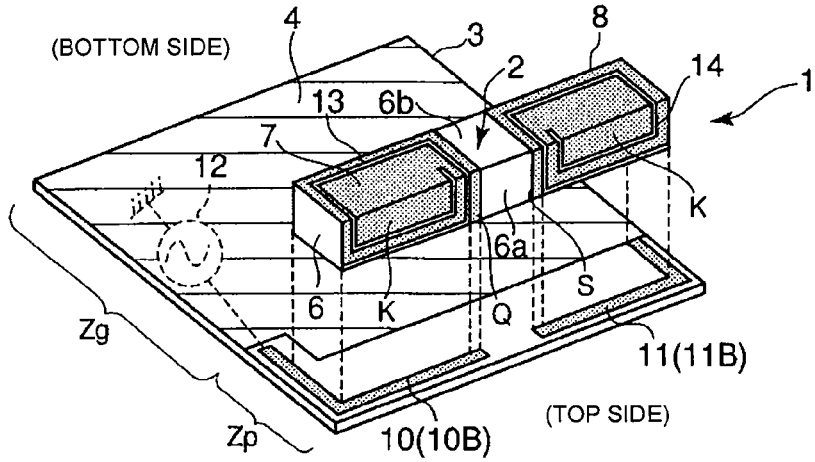
FIG. 1*b* is an exploded view schematically showing the antenna structure shown in FIG. 1*a*.
Figure 1C:
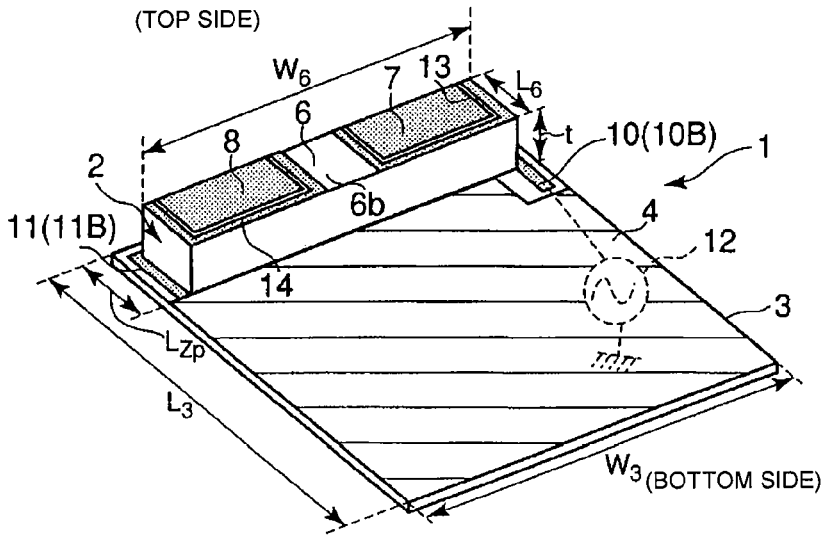
FIG. 1*c* is an illustration schematically showing the antenna structure shown in FIG. 1*a* when viewed from a bottom side.

FIG. 1*a* is a perspective view schematically showing an antenna structure according to a first embodiment. FIG. 1*b* is an exploded view schematically showing the antenna structure. FIG. 1*c* shows the antenna structure according to the first embodiment when viewed from a bottom side. In an antenna structure 1 according to the first embodiment, a feed radiation electrode 7 and a non-feed radiation electrode 8 of an antenna 2 have characteristics. Apart from this, the antenna structure 1 according to the first embodiment has a configuration similar to that of the antenna structure shown in FIG. 11*a*.

Figure 2:
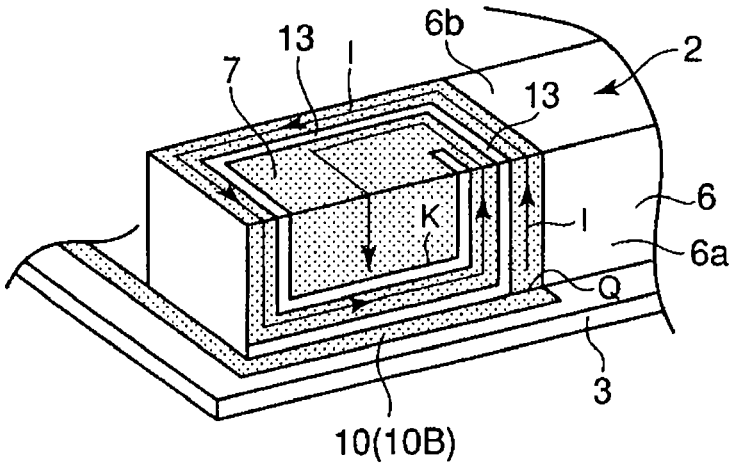
FIG. 2 is an enlarged view schematically showing a feed radiation electrode shown in FIG. 1*a*.

As shown by a schematic enlarged view of FIG. 2, the feed radiation electrode 7 of the antenna 2 forming the antenna structure 1 according to the first embodiment is provided on two surfaces, a side surface 6*a* near a top side and an upper surface 6*b*, of a dielectric base member 6. In the feed radiation electrode 7, a slit 13 is formed in two surfaces, the side surface 6*a* near the top side and the upper surface 6*b*, of the dielectric base member 6. Due to the formation of the slit 13 in the feed radiation electrode 7, a current path I of a fundamental mode is formed by extending from a feed end Q connected to a feed electrode 10 (10B) to an open end K via a looped path formed on the side surface 6*a* near the top side and the upper surface 6*b* of the dielectric base member 6.

In the first embodiment, the feed electrode 10 (10B) is provided in a non-ground region Zp of a circuit board 3 along the side surface 6*a* of the dielectric base member 6 near the top side and a left side surface of the dielectric base member 6 shown in FIGS. 1*a* and 2. In the first embodiment, the feed radiation electrode 7 is provided on the upper surface 6*b* of the dielectric base member 6 and the side surface 6*a* near the top side. Thus, the space between a feed radiation electrode portion formed on the side surface 6*a* near the top side and the feed electrode 10 (10B) is small, and the capacitance between the feed radiation electrode portion of the side surface 6*a* near the top side and the feed electrode 10 (10B) is large enough for affecting the antenna characteristics. In the first embodiment, the capacitance between the feed radiation electrode portion of the side surface 6*a* near the top side and the feed electrode 10 (10B) is appropriate for improving the antenna characteristics.

In the first embodiment, the feed radiation electrode 7 and the non-feed radiation electrode 8 that are provided on the dielectric base member 6 have shapes symmetrical to each other with respect to a central plane that passes through an intermediate position between the feed radiation electrode 7 and the non-feed radiation electrode 8 and that is perpendicular to a board surface. That is, the non-feed radiation electrode 8 has a configuration similar to that of the feed radiation electrode 7. The non-feed radiation electrode 8 is provided on the side surface 6*a* near the top side and the upper surface 6*b* of the dielectric base member 6. In the non-feed radiation electrode 8, a slit 14 is formed in two surfaces, the side surface 6*a* near the top side and the upper surface 6*b* of the dielectric base member 6. Due to the formation of the slit 14, in the non-feed radiation electrode 8, a current path of a fundamental mode is formed by extending from a short end S connected to a feed electrode 11 (11B) to an open end K via a looped path formed on the two surfaces, the side surface 6*a* near the top side and the upper surface 6*b*, of the dielectric base member 6. When the feed radiation electrode 7 and the non-feed radiation electrode 8 are viewed from the top side of FIG. 1*a*, the current path of the feed radiation electrode 7 has a counterclockwise loop shape, and the current path of the non-feed radiation electrode 8, which has a shape symmetrical to the feed radiation electrode 7, has a clockwise loop shape.

In addition, the non-feed radiation electrode 8 is provided on the upper surface 6*b* and the side surface 6*a* near the top side of the dielectric base member 6. Thus, the space between a non-feed radiation electrode portion formed on the side surface 6*a* near the top side and the ground connection electrode 11 (11B) is small, and the capacitance between the non-feed radiation electrode portion of the side surface 6*a* near the top side and the ground connection electrode 11 (11B) is large enough for affecting the antenna characteristics. In the first embodiment, the capacitance between the non-feed radiation electrode portion of the side surface 6*a* near the top side and the ground connection electrode 11 (11B) is appropriate for improving the antenna characteristics.

In the first embodiment, the dielectric base member 6 is formed of resin materials including a material for increasing a dielectric constant. Conductor plates forming the feed radiation electrode 7 and the non-feed radiation electrode 8 are integrated with the dielectric base member 6 by a molding technique, such as insert molding.

Since the antenna structure 1 according to the first embodiment has the characteristic configuration described above, the antenna performance can be improved. This is verified by experiments performed by the inventors. In the experiments, a sample A having the configuration of the antenna structure 1 according to the first embodiment shown in FIG. 1*a* and a sample B having the configuration of the antenna structure 1 according to the known technology shown in FIG. 11*a* are prepared. The return loss characteristics and antenna efficiency of each of the samples A and B are measured. Apart from the shapes of the feed radiation electrode 7 and the non-feed radiation electrode 8, the samples A and B have the same conditions, as described below. That is, the length $L_3$ (see FIG. 1*c* ) of the circuit board 3 of each of the samples A and B is 82 mm, the width $W_3$ of the circuit board 3 of each of the samples A and B is 40 mm. The length $L_{zp}$ of the non-ground region Zp disposed on one end of the circuit board 3 is 8 mm, and the width of the non-ground region Zp is 40 mm. The length $L_6$ of the dielectric base member 6 is 8 mm, the width $W_6$ of the dielectric base member 6 is 38 mm, and the height t of the dielectric base member 6 is 5.5 mm.

Figure 3:
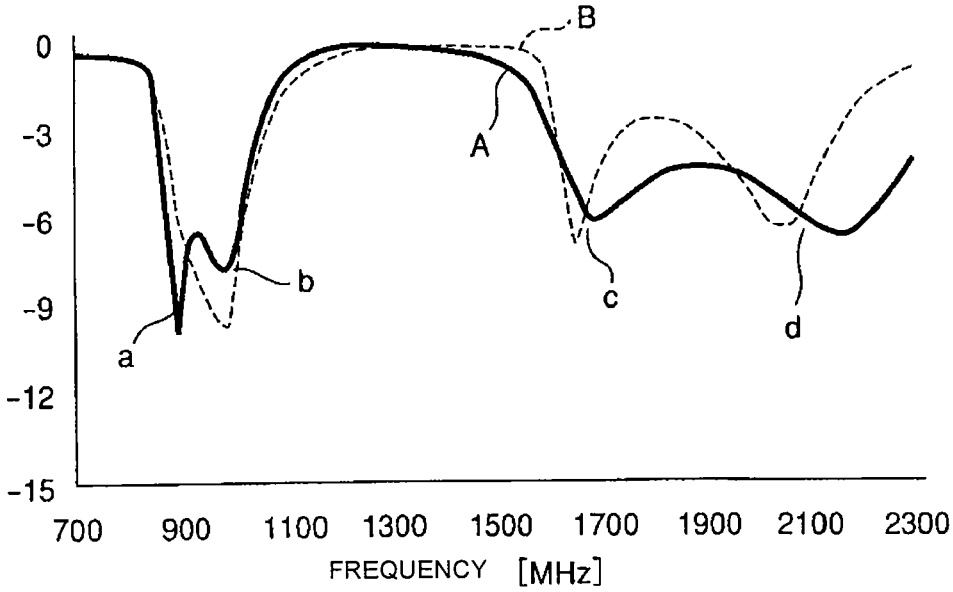
FIG. 3 is a graph showing an example of return loss characteristics for explaining an advantage achieved by the configuration of the antenna structure according to the first embodiment.

Experimental results of the return loss characteristics are shown in the graph of FIG. 3. In FIG. 3, a solid line A represents the sample A (that is, a sample having the characteristic configuration according to the first embodiment). In addition, a dotted line B represents the sample B (that is, a sample having the known configuration). In the graph, a sign a represents a frequency band in a fundamental mode of the non-feed radiation electrode 8, and a sign b represents a frequency band in the fundamental mode of the feed radiation electrode 7. In addition, a sign c represents a frequency band in a higher-order mode of the non-feed radiation electrode 8, and a sign d represents a frequency band in the higher-order mode of the feed radiation electrode 7.

In addition, experimental results of the antenna efficiency are shown in Tables 1 to 4. Table 1 shows antenna efficiency in a frequency band between 880 MHz and 960 MHz. Table 1 is represented as a graph, as shown in FIG. 4*a*. Table 2 shows antenna efficiency in a frequency band between 1710 MHz and 1880 MHz. Table 2 is represented as a graph, as shown in FIG. 4*b*. Table 3 shows antenna efficiency in a frequency band between 1850 MHz and 1990 MHz. Table 3 is represented as a graph, as shown in FIG. 4*c*. Table 4 shows antenna efficiency in a frequency band between 1920 MHz and 2170 MHz. Table 4 is represented as a graph, as shown in FIG. 4*d*. In each of FIGS. 4*a* to 4*d*, a solid line A represents the sample A (that is, the sample having the characteristic configuration according to the first embodiment), and a dotted line B represents the sample B (that is, the sample having the known configuration).

TABLE 1

| | FREQUENCY (MHz)) | | | | | | |
|---|---|---|---|---|---|---|---|
| | 880 | 897.5 | 915 | 925 | 942.5 | 960 | AVERAGE |
| SAMPLE A | −1.6 | −1.5 | −1.8 | −2.0 | −1.6 | −1.1 | −1.6 |
| SAMPLE B | −2.8 | −1.8 | −1.7 | −1.9 | −1.5 | −1.1 | −1.8 |

TABLE 2

| | FREQUENCY (MHz) | | | | | | |
|---|---|---|---|---|---|---|---|
| | 1710 | 1747.5 | 1785 | 1805 | 1852.5 | 1880 | AVERAGE |
| SAMPLE A | −1.3 | −1.8 | −2.2 | −2.1 | −2.5 | −2.5 | −2.0 |
| SAMPLE B | −2.2 | −3.3 | −3.9 | −3.8 | −3.8 | −3.6 | −3.4 |

TABLE 3

| | FREQUENCY (MHz) | | | | | | |
|---|---|---|---|---|---|---|---|
| | 1850 | 1880 | 1910 | 1930 | 1960 | 1990 | AVERAGE |
| SAMPLE A | −2.4 | −2.5 | −2.4 | −2.2 | −1.7 | −1.5 | −2.1 |
| SAMPLE B | −3.9 | −3.6 | −3.3 | −3.1 | −2.2 | −1.7 | −2.9 |

TABLE 4

| | FREQUENCY (MHz) | | | | | | |
|---|---|---|---|---|---|---|---|
| | 1920 | 1950 | 1980 | 2110 | 2140 | 2170 | AVERAGE |
| SAMPLE A | −2.5 | −2.2 | −2.4 | −1.6 | −1.6 | −1.8 | −2.0 |
| SAMPLE B | −3.4 | −2.7 | −2.6 | −3.0 | −3.9 | −4.7 | −3.3 |

As is clear from the return loss characteristics shown in FIG. 3, by providing the characteristic configuration according to the first embodiment, in particular the higher-order mode in the frequency bandwidth is achieved. In addition, as is clear from Tables 1 to 4 and FIGS. 4*a* to 4*d*, by providing the characteristic configuration according to the first embodiment, an improvement in the antenna efficiency is achieved. In particular, such an advantage is enhanced in the higher-order mode.

In the first embodiment, in addition to the feed radiation electrode 7, the non-feed radiation electrode 8, which is electromagnetically coupled to the feed radiation electrode 7 to produce a multiple-resonance state, is formed on the dielectric base member 6. Thus, in the antenna structure 1 according to the first embodiment, due to a multiple resonance produced by the feed radiation electrode 7 and the non-feed radiation electrode 8, a frequency bandwidth can be increased.

In addition, in the first embodiment, the feed radiation electrode 7 and the non-feed radiation electrode 8 have shapes symmetrical to each other. Thus, excellent impedance matching for a multiple resonance produced by the feed radiation electrode 7 and the non-feed radiation electrode 8 can be easily achieved. In addition, when an antenna operation in a fundamental mode with the lowest resonant frequency among a plurality of resonant frequencies of each of the feed radiation electrode 7 and the non-feed radiation electrode 8 and an antenna operation in a higher-order mode with a resonant frequency higher than that in the fundamental mode are performed, in a plurality of resonant modes between the fundamental mode and the higher-order mode, an advantage in which excellent impedance matching for a multiple resonance produced by the feed radiation electrode 7 and the non-feed radiation electrode 8 can be easily achieved can be realized. A reason for this advantage is that symmetrical electromagnetic field distribution can be easily achieved between the feed radiation electrode 7 and the non-feed radiation electrode 8 in both the fundamental mode and the higher-order mode.

The antenna structure 1 according to the first embodiment may be contained within a folding-type portable telephone 16, as shown in FIG. 5*a*. The folding-type portable telephone 16 has a configuration in which two casings 18 and 19 are coupled to each other with a hinge portion 17 therebetween. When the antenna structure 1 according to the first embodiment is contained within the folding-type portable telephone 16, for example, a circuit board (not shown) housed within, for example, the casing 19 of the portable telephone 16 serves as the circuit board 3 of the antenna structure 1. In addition, an end of the circuit board near the hinge portion 17 serves as the non-ground region Zp, and the antenna 2 is mounted in the non-ground region Zp.

When the portable telephone 16 is used, as shown in FIG. 5*b*, a region in which the hinge portion 17 is formed of the portable telephone 16 is often held by a human hand 20. Thus, when the antenna structure 1 is contained within the portable telephone 16, as described above, the human hand (finger) 20 is placed above the dielectric base member 6 forming the antenna structure 1. Thus, radiation of radio waves from the feed radiation electrode 7 and the non-feed radiation electrode 8 is often blocked by the hand 20. However, in the antenna structure 1 according to the first embodiment, since the feed radiation electrode 7 and the non-feed radiation electrode 8 are provided on the side surface 6*a* near the top side as well as the upper surface 6*b* of the dielectric base member 6, even if the hand 20 or the like is placed above the dielectric base member 6, radio waves can be radiated from the feed and non-feed radiation electrode portions formed on the side surface 6*a* near the top side in an excellent manner. Thus, deterioration in the antenna characteristics can be reduced, and the reliability in radio communication of the portable telephone 16 can be increased. In addition, when a high-dielectric material other than the hand 20, such as metal, is placed above the dielectric base member 6, radio waves can be radiated from the feed and non-feed radiation electrode portions formed on the side surface 6*a* near the top side in an excellent manner, as in the above description. Thus, deterioration in the antenna characteristics can be reduced. That is, the antenna structure 1 according to the first embodiment has a configuration that is capable of reducing a negative effect of an object, such as the hand 20 or metal, when the metal or the high-dielectric material (the human finger or hand) is placed above the feed radiation electrode 7 and the non-feed radiation electrode 8. Thus, the reliability in radio communication of the folding-type portable telephone 16 can be increased.

In the example shown in FIG. 1*a*, the feed radiation electrode 7 and the non-feed radiation electrode 8 have shapes substantially symmetrical to each other. However, the feed radiation electrode 7 and the non-feed radiation electrode 8 may have shapes similar to each other or may have shapes different from each other. In addition, the dielectric base member 6 may rise and protrude into at least part of an edge portion or a slit edge portion of the feed radiation electrode 7 or the non-feed radiation electrode 8. A dielectric base member portion protruding into the edge portion or the slit edge portion of the feed radiation electrode 7 or the non-feed radiation electrode 8 in a state of fastening the edge portion or the slit edge portion of the feed radiation electrode 7 or the non-feed radiation electrode 8 to the dielectric base member 6. Thus, separation of the feed radiation electrode 7 from the dielectric base member 6 or separation of the non-feed radiation electrode 8 from the dielectric base member 6 can be prevented.

In addition, the feed radiation electrode 7 shown in FIG. 1*a* has a shape in which a current of the fundamental mode that electrically connects the feed radiation electrode 7 defines a looped current path I, as shown in a model diagram of FIG. 6. However, for example, the feed radiation electrode 7 may have a shape (see, for example, FIG. 7*b*) that defines a looped current path I, as shown in a model diagram of FIG. 7*a*. Alternatively, the feed radiation electrode 7 may have a shape (see, for example, FIG. 8*b*) that defines a looped current path I, as shown in a model diagram of FIG. 8*a*. In addition, the feed radiation electrode 7 is provided on two surfaces, the side surface 6*a* near the top side and the upper surface 6*b*, of the dielectric base member 6. However, for example, the feed radiation electrode 7 may be provided on three or more surfaces of the dielectric base member 6 such that the feed radiation electrode 7 is not only provided on the two surfaces, the side surface 6*a* near the top side and the upper surface 6*b*, of the dielectric base member 6 but also protrudes onto a side surface that faces the ground region Zg of the dielectric base member 6 or a left side surface in FIG. 2.

In addition, the non-feed radiation electrode 8 may have a shape similar to the feed radiation electrode 7 shown in FIG. 7*b* or FIG. 8*b*. Alternatively, the non-feed radiation electrode 8 may have a shape symmetrical to the feed radiation electrode 7 shown in FIG. 7*b* or FIG. 8*b*.

In addition, in the configuration shown in FIG. 1*a*, the feed electrode 10 (10B) is an electrode pattern directly formed on the circuit board 3. However, for example, as shown in FIG. 9, the feed electrode 10 (10B) may be formed of part of a conductor plate disposed in the non-ground region Zp of the circuit board 3 and forming the feed radiation electrode 7.

A second embodiment is described next. In the explanations of the second embodiment, the same component parts as in the first embodiment are referred to with the same reference numerals and the descriptions of those same parts will be omitted here.

In the second embodiment, as shown in a side view of FIG. 10, the antenna 2 (the feed radiation electrode 7 and the non-feed radiation electrode 8) is provided in the non-ground region Zp of the circuit board 3 such that part of the antenna 2 (the feed radiation electrode 7 and the non-feed radiation electrode 8) protrudes from the non-ground region Zp of the circuit board 3 toward the outside of the board. Apart from this, a configuration similar to that of the first embodiment is provided.

In the second embodiment, since part of the antenna 2 (the feed radiation electrode 7 and the non-feed radiation electrode 8) protrudes from the non-ground region Zp of the circuit board 3 toward the outside of the board, compared with a case where the entire feed radiation electrode 7 and the non-feed radiation electrode 8 are provided within the non-ground region Zp, the space between the ground region Zg and each of the feed radiation electrode 7 and the non-feed radiation electrode 8 can be set apart by the amount of protrusion toward the outside the circuit board 3. Thus, since a negative effect of ground is reduced, an increase in the frequency bandwidth for radio communication and an improvement in the antenna efficiency can be achieved. Accordingly, a miniaturized and lower-profile antenna structure 1 can be achieved. In addition, miniaturization of a radio communication apparatus including the antenna structure 1 having such a configuration can be easily achieved.

A third embodiment is described next. The third embodiment relates to a radio communication apparatus. The radio communication apparatus according to the third embodiment is characterized by including the antenna structure 1 according to the first or second embodiment. As a configuration other than the antenna structure in the radio communication apparatus, there are various possible configurations. Any configuration may be adopted, and the explanation of the configuration is omitted here. In addition, since the antenna structure 1 according to the first or second embodiment has been explained above, the explanation of the antenna structure 1 according to the first or second embodiment is omitted here.

The present invention is not limited to each of the first to third embodiments, and various other embodiments are possible. For example, in each of the first to third embodiments, in addition to the feed radiation electrode 7, the non-feed radiation electrode 8 is provided on the dielectric base member 6. However, for example, if a required frequency bandwidth and a required number of frequency bands can be achieved only by the feed radiation electrode 7, the non-feed radiation electrode 8 may be omitted.

In addition, in each of the first to third embodiments, similarly to the feed radiation electrode 7, the non-feed radiation electrode 8 has a shape in which a current path in the fundamental mode has a loop shape. However, for example, the non-feed radiation electrode 8 may have a shape shown in FIG. 11*a*, and the non-feed radiation electrode 8 does not necessarily have a shape in which the current path in the fundamental mode has a loop shape.

In addition, in each of the first to third embodiments, a slit is formed in a planer electrode of each of the feed radiation electrode 7 and the non-feed radiation electrode 8 so that a current path in the fundamental mode of each of the radiation electrodes 7 and 8 has a loop shape. However, for example, in each of the feed radiation electrode 7 and the non-feed radiation electrode 8, a linear or strip-shaped electrode may have a loop shape.

In addition, in each of the first to third embodiments, a single feed radiation electrode 7 and a single non-feed radiation electrode 8 are provided on the dielectric base member 6. However, in accordance with a required frequency bandwidth and a necessary number of frequency bands, a plurality of feed radiation electrodes 7 and a plurality of non-feed radiation electrodes 8 may be provided on the dielectric base member 6.

In addition, in each of the first to third embodiments, the feed electrode 10 (10B) and the ground connection electrode 11 (11B) are provided in the non-ground region zp of the circuit board 3. However, the feed electrode 10 (10B) and the ground connection electrode 11 (11B) only need to be provided in a region in which the ground 4 is not formed. For example, the feed electrode 10 (10B) and the ground connection electrode 11 (11B) may be formed of conductor plates, and the feed electrode 10 (10B) and the ground connection electrode 11 (11B) may be provided outside the circuit board 3 such that the feed electrode 10 (10B) and the ground connection electrode 11 (11B) project from the circuit board 3.

An antenna structure according to the present invention is applicable to an antenna structure of various radio communication apparatuses. Since the antenna structure according to the present invention is capable of being contained within a casing of a radio communication apparatus, a radio communication apparatus whose antenna does not protrude from a casing of the radio communication apparatus can be provided. Thus, the antenna structure according to the present invention is particularly effective for a radio communication apparatus for which an excellent design is desired and for a portable radio communication apparatus.

What is claimed is:

1. An antenna structure comprising:

a board having a ground region in which a ground is formed and a non-ground region, the ground region and the non-ground region being positioned adjacent to each other such that the non-ground region is disposed on one end of the board;

a dielectric base member provided in at least part of the non-ground region of the board, the dielectric base member including a first surface and a second surface next to the first surface;

a feed radiation electrode provided on at least the first surface and the second surface of the dielectric base member, a first end of the feed radiation electrode defining a feed end on the first surface of the dielectric base member, a second end of the feed radiation electrode defining an open end, the feed radiation electrode being configured such that a current path extending from the feed end to the open end has a loop shape and such that a capacitance is formed between a portion of the feed radiation electrode on the first surface of the dielectric base member and the feed electrode; and a feed electrode connected to the feed end of the feed radiation electrode and provided on the side surface of the dielectric base member.

2. The antenna structure according to claim 1, wherein the first surface of the dielectric base member is within the non-ground region of the board.

3. The antenna structure according to claim 1, wherein the feed electrode is provided in the non-ground region of the board.

4. The antenna structure according to claim 1, wherein the dielectric base member is a rectangular column shape.

5. The antenna structure according to claim 1, further comprising a circuit for radio communication provided in the ground region of the board, the circuit being connected to the feed electrode.

6. A radio communication apparatus comprising the antenna structure as set forth in claim 1.

7. The radio communication apparatus according to claim 6, wherein the radio communication apparatus is a folding-type portable telephone having a configuration in which two casings are coupled to each other with a hinge portion therebetween, wherein an end of the board near the hinge portion contained within one of the two coupled casings defines the non-ground region, and wherein the feed radiation electrode of the antenna structure is provided in the non-ground region.

8. An antenna structure comprising:

a board having a ground region in which a ground is formed and a non-ground region, the ground region and the non-ground region being positioned adjacent to each other such that the non-ground region is disposed on one end of the board;

a dielectric base member provided in at least part of the non-ground region of the board, the dielectric base member including a first surface and a second surface next to the first surface;

a feed radiation electrode provided on at least the first surface and the second surface of the dielectric base member, a first end of the feed radiation electrode defining a feed end on the first surface of the dielectric base member, a second end of the feed radiation electrode defining an open end, the feed radiation electrode being configured such that a current path extending from the feed end to the open end has a loop shape and such that a capacitance is formed between a portion of the feed radiation electrode on the first surface of the dielectric base member and the feed electrode; and a feed electrode connected to the feed end of the feed radiation electrode and provided on the side surface of the dielectric base member;

a non-feed radiation electrode provided on the dielectric base member and spaced from the feed radiation electrode, the non-feed radiation electrode electromagnetically coupled to the feed radiation electrode to produce a multiple-resonance state, a first end of the non-feed radiation electrode defining a short end on the first surface of the dielectric base member, a second end of the non-feed radiation electrode defining an open end, the non-feed radiation electrode being configured such that a current path extending from the short end to the open end has a loop shape and such that a capacitance is formed between a portion of the non-feed radiation electrode on the first surface of the dielectric base member and the ground connection electrode; and a ground connection electrode connected to the short end of the non-feed radiation electrode.

9. The antenna structure according to claim 8, wherein the feed radiation electrode and the non-feed radiation electrode are symmetrical.

10. A radio communication apparatus comprising the antenna structure as set forth in claim 8.

11. The radio communication apparatus according to claim 10, wherein the radio communication apparatus is a folding-type portable telephone having a configuration in which two casings are coupled to each other with a hinge portion therebetween, wherein an end of the board near the hinge portion contained within one of the two coupled casings defines the non-ground region, and wherein both the feed radiation electrode and the non-feed radiation electrode are provided in the non-ground region.

* * * * *